US006854134B2

(12) United States Patent
Cleveland

(10) Patent No.: US 6,854,134 B2
(45) Date of Patent: Feb. 15, 2005

(54) PROTECTIVE COLLAR

(75) Inventor: Paul Cleveland, Templestowe (AU)

(73) Assignee: Garry Dubois and Co Pty. Ltd., Moorabbin (AU)

( * ) Notice: Subject to any disclaimer, the term of this patent is extended or adjusted under 35 U.S.C. 154(b) by 0 days.

(21) Appl. No.: 10/476,562

(22) PCT Filed: May 3, 2002

(86) PCT No.: PCT/AU02/00547

§ 371 (c)(1),
(2), (4) Date: Oct. 31, 2003

(87) PCT Pub. No.: WO02/089620

PCT Pub. Date: Nov. 14, 2002

(65) Prior Publication Data

US 2004/0128744 A1 Jul. 8, 2004

(30) Foreign Application Priority Data

May 3, 2001 (AU) ..... PR 4745

(51) Int. Cl.[7] ..... A42B 1/24
(52) U.S. Cl. ..... 2/422; 2/424; 2/468
(58) Field of Search ..... 2/425, 410, 424, 2/422, 468, 415, 421, 411

(56) References Cited

U.S. PATENT DOCUMENTS

| | | | | | |
|---|---|---|---|---|---|
| 4,017,906 A | * | 4/1977 | Bochynsky et al. | ..... | 2/10 |
| 4,186,736 A | * | 2/1980 | Angioletti et al. | ..... | 128/201.19 |
| 4,532,658 A | * | 8/1985 | Zago | ..... | 2/421 |
| 4,573,222 A | * | 3/1986 | Zago | ..... | 2/424 |
| 4,590,622 A | * | 5/1986 | Wolfe et al. | ..... | 2/462 |
| 4,697,289 A | * | 10/1987 | Luigi | ..... | 2/422 |
| 5,095,550 A | * | 3/1992 | Perlinger | ..... | 2/422 |
| 5,271,103 A | * | 12/1993 | Darnell | ..... | 2/418 |
| 5,546,601 A | | 8/1996 | Abeyta | ..... | 2/2 |
| 6,058,517 A | * | 5/2000 | Hartunian | ..... | 2/468 |

FOREIGN PATENT DOCUMENTS

| | | | | |
|---|---|---|---|---|
| DE | 2921353 A1 | * | 12/1980 | ..... A42B/3/02 |
| NO | 311551 B1 | * | 12/2001 | ..... A42B/3/04 |
| WO | WO 94/26136 | | 11/1994 | |
| WO | WO 97/05796 | | 2/1997 | |
| WO | WO 9809545 A1 | * | 3/1998 | ..... A41D/13/00 |

OTHER PUBLICATIONS

Teamtech Helmet Accessories Products Page, Teamtech, Inc.—Motorsports Equipment, pp. 1–7, Jan. 3, 2002.

* cited by examiner

*Primary Examiner*—Rodney M. Lindsey
(74) *Attorney, Agent, or Firm*—Sheridan Ross PC

(57) ABSTRACT

The invention provides a protective collar for use with a full-face crash helmet, particularly for use in motor sports. The collar is at least partially formed from a resilient material that in use extends peripherally entirely around a user's neck. The collar has a recess in which a lower part of the crash helmets is received and secured, and helmet retaining means (e.g loop-pile fastening strips) are provided for retaining the helmet within the recess. The recess has an upwardly facing bottom surface which abuts the lower part of the helmet and a peripherally extending, inwardly facing wall surface which extends upwardly from the bottom surface. The wall surface closely fits against the lower part of the helmet around the periphery of the helmet. The collar is shaped to limit movement, both laterally and in a fore-and-aft direction, of the wearer's head in the event of a violent acceleration or deceleration, such as may occur in an accident.

19 Claims, 6 Drawing Sheets

PROTECTIVE COLLAR

The invention disclosed below relates to a protective collar used to enhance the protection given by a crash helmet to the head and neck of a wearer, when engaged in such activities as motor racing.

It is nowadays a virtually universal practice—and often a requirement—for participants in such sports as motor racing (including open wheel, speedway, dragster-type, sports cars and sedan cars and even go karts) and motor boat racing to wear crash helmets for protection in the event of an accident. Such helmets help to protect the head and upper neck of their wearer, and are considered to be of proven benefit. From early bowl-shaped helmets which simply covered the top of the head, to helmets extending downwards approximately to the wearer's jawline at the sides and partly down the rear of the head to cover the upper neck, there have evolved "full face" helmets which also have a section extending around the wearer's chin, the face being protected by a transparent visor. Such helmets are also widely worn by motorcyclists for ordinary use on public roads.

In sporting applications particularly, other protective equipment has been developed for wearing by participants, such as protective suits, boots and the like. Vehicles other than motorcycles have been fitted with reinforced structures, rapidly-deployable airbags and restraining harnesses for further protection.

Yet collisions and other types of accidents occur and injuries incurred in them may still be very severe, and these include injuries to the upper neck and head areas of persons wearing full-face crash helmets. One measure which has been taken to give additional protection to such persons is the use of a collar of resilient material worn between the upper body and the base of a crash helmet. Some such collars are split at the front so that they can be more easily placed around the neck and have fastenings at the front so that once around the neck they will remain there. These can limit to some degree the movement of a helmet (and the head inside it) during an impact or rapid deceleration. They can, however, be uncomfortable and unduly restrictive to head movement in ordinary situations, as when a wearer wishes to look quickly from side to side while driving in a race.

It should be understood that the combination of a head and a helmet is of considerable weight and if it is allowed to move violently in an impact, rapid deceleration or other event, large stresses can be placed on the upper spine, potentially leading to excessive extension and/or bending resulting in injury such as spine fractures, "whiplash", other soft tissue injuries and the like.

A related development has been the provision of collars which themselves employ rapidly-deployable airbags which inflate when an impact is sensed, the inflated bag purportedly protecting the upper body and steadying the helmet against excessively violent movement. Such devices are expensive and comparatively complex and appear not to have become popular.

The present invention has been developed to provide protection against the effects of excessively violent movement of the head and neck of a full-face crash helmet wearer more effectively than the simple resilient collars mentioned above and without the complexity, expense and possible unreliability of airbag-type devices. A particular objective has been to improve the protection of a full-face crash helmet wearer in the event of a side impact. An additional objective has been to give such protection while limiting as little as possible the freedom of movement of the wearer.

SUMMARY OF THE INVENTION

According to the invention there is provided a protective collar for use with full-face crash helmets, including a collar member at least partially formed from a resilient material which in use extends peripherally entirely around a user's neck said collar member having a recess in which a lower part of a full-face crash helmet is receivable and securable and helmet retaining means for retaining said crash helmet within said recess, said recess having an upwardly facing bottom surface which in use abuts said lower part of said helmet and a peripherally extending wall surface which extends upwardly from said surface to a top surface of said collar, faces into said recess and in use of said collar closely fits against said lower part of said helmet around the periphery thereof, wherein in use of said collar said user's neck passes through an opening in said collar member, said opening having an upper end within said recess and inwardly facing surfaces conforming closely to at least both sides and the back of said user's neck.

The feature of close fitting of the protective collar in particular, in combination with the other features mentioned above, gives advantages in use which will be further explained below. Preferably, the periphery of said opening said collar has a thickness greater than or equal to the average depth of said recess. This thickness, below said recess in a direction perpendicular to said bottom surface, may be substantially constant. A front part of said opening in use of said collar may extend in a forward direction clear of said user's neck. This is for comfort—for example to clear a wearer's "Adam's apple"—and to provide an air inlet to the helmet interior.

Preferably, the collar member has a split at a peripheral location so that parts of said collar on opposing sides of said split are separable by a user to enable said collar to be fitted around said lower part of said helmet. This facilitates putting the collar on after the helmet is secured to the wearer's head in conventional fashion. It is then desirable that the collar include closure means for holding said parts on opposing sides of said split in defined positions against each other after fitting of said collar around said helmet.

Loop-pile fasteners of the type known by the trade name "Velcro" are particularly suitable for the closure means and may be applied in several ways. Thus, the closure means may include a strap secured to said collar member and having secured at one end thereof a first half of a loop-pile fastener combination such as "Velcro", a second half of said fastener combination being secured to said collar member and located so that when said fastener halves are mated with each other said split is held closed. Preferably, this strap is secured to an external surface of said collar member. It may provide significant reinforcement or stiffening for the collar member.

Alternatively, the closure means may include a strap secured to said collar member and having secured at one end thereof a first half of a loop-pile fastener combination such as "Velcro", a second half of said fastener combination being secured to a second end of said strap and said strap being secured to an external surface of said collar member. This strap can extend substantially entirely around the collar member's periphery and, again, provide a significant reinforcement or stiffening effect.

In yet another alternative, the closure means may include a strap secured to said collar member and having secured at one end thereof a first half of a loop-pile fastener combination such as "Velcro", a second half of said fastener combination being secured to a second strap and said strap and said second straps being secured to external surfaces of said collar member. In this case, extending the first and second straps around a large part of the collar member's periphery can stiffen or reinforce it.

Preferably, the split is at a peripheral location which in use of said collar is at the most forward point of said collar. It is also preferred that said parts of said collar on opposing sides of said split have formations which in use of said collar fit cooperatively against each other.

It is especially preferred that said collar member includes left and right formations on opposing sides which in use with said user in a looking-straight-ahead position are located adjacently to left and right upper surfaces of said user's thorax between said user's neck and left and right shoulders and which are shaped and extend downwardly so as to be close to but clear of said surfaces. Alternatively, these formations may in use contact said surfaces, but sufficiently lightly to allow rotation of said helmet by said user without substantial restriction.

It is also especially preferred that said collar member includes at least one downwardly depending front formation at a front part of said collar member which in use is located adjacently to and clear of a clothed surface of an upper chest portion of said user and which is adapted to contact said clothed surface of said upper chest portion in the event of a predetermined amount of forward bending of said user's neck from a normal looking-straight-ahead position. In particular, there may be two said front formations on said collar member said two front formations being laterally spaced apart from each other. This allows air to pass between them for ventilation of the helmet interior as disclosed below.

It is further especially preferred that said collar member includes a formation downwardly depending from a rear part thereof which in use is located adjacently to and clear of a the nape of the neck (or a surface of clothing thereon) and which is adapted to contact the said nape or surface of clothing in the event of a predetermined amount of rearward bending of said user's neck from a normal looking-straight-ahead position.

Said helmet retaining means may include at least one loop-and-pile fastener part secured to said collar member within said recess and positioned to mate with a cooperating part of said loop-and-pile fastener on said lower part of said helmet when said lower part is received in said recess.

Preferably, the collar member is formed at least in part from a resilient expanded plastics foam. It may even more preferably be formed as a single integral member.

The appended claims are explicitly made a part of this disclosure.

A preferred embodiment of the invention will now be described in detail by reference to the following Figures.

DESCRIPTION OF PREFERRED EMBODIMENT

Figure 1:
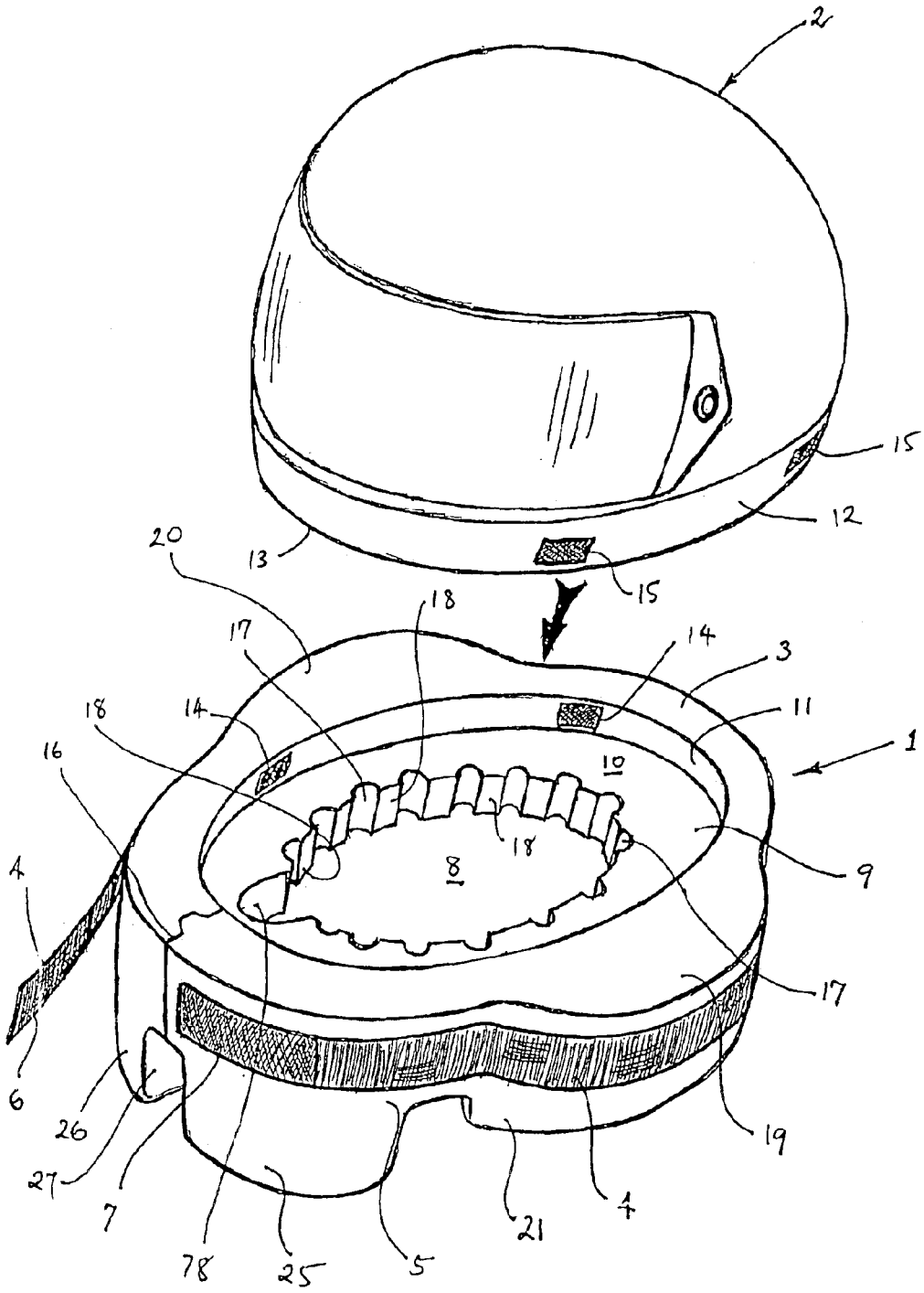
FIG. 1 is a perspective view of a protective collar according to the invention, together with a full-face crash helmet.

FIG. 1 shows a protective collar 1 according to the invention, together with a full-face crash helmet 2 with which collar 1 is used. Collar 1 includes as its main component a collar member 3 formed as a single piece of expanded plastics foam of suitable resilience and deformability. Collar 1 also includes a webbing strap 4. To one end of the strap 4 is secured a pad 6 which forms a first half of a loop-pile fastener of known type (available for example under the trade name "Velcro"). The strap 4 extends peripherally around, and is secured over most of its length by adhesive to, an external surface 5 of collar member 3. Secured to a second end of strap 4 is a pad 7 forming a second half of the loop-pile fastener.

Collar member 3 is generally ring-shaped, with a central opening 8 within a recess 9. Recess 9 is defined by a lower surface 10 and an inwardly-facing wall 11 upstanding from surface 10 and extending peripherally around collar member 3. Recess 9 is so shaped and sized that a lower part 12 of helmet 2 can be received in recess 9, snugly fitting therein around its entire periphery and with its lower rim 13 abutting surface 10. To retain helmet 2 within recess 9, recess 9 is provided with several loop-pile fastener halves 14, each positioned to cooperate with loop-pile fastener halves 15 secured to helmet 2.

In use of the collar 1, the neck of a user 23 (not shown in FIG. 1) passes through opening 8. The collar member 3 has a split 16 extending through it at its forwardmost point, so that it can be sprung apart there by a user wearing helmet 2 and placed around helmet 2. Adjoining loop-pile fastener halves 14 and 15 then mate with each other. Then, to fully secure collar 1 in position, ends of strap 4 are passed to each other so that pads 6 and 7 abut and fasten strap 4 snugly around the surface 5 of collar member 3. Some tension can be put in the strap 4 so that the split 16 is kept firmly closed.

Figure 4:
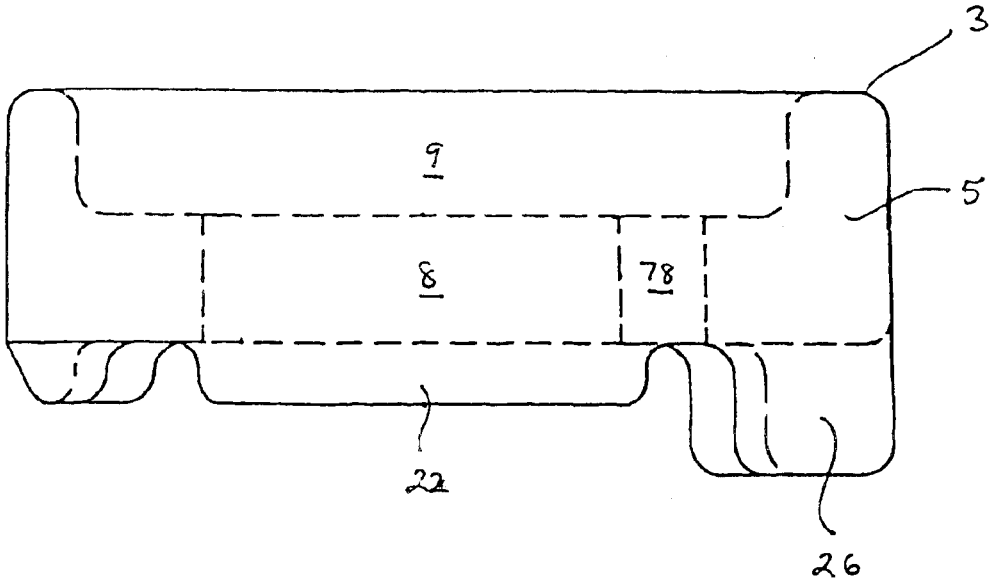
FIG. 4 is a side elevation of the component shown in FIG. 2, taken in the direction of arrow "B"

Below surface 10, collar member 3 is of a substantial (and in this preferred embodiment substantially constant) thickness, typically greater than the depth of recess 9. Opening 8 is sized and shaped so that around most of its periphery it closely fits against the user's neck. To minimize possible discomfort, longitudinally-extending flutes 17 are provided around the periphery so that only surfaces 18 actually contact the neck. Flutes 17 allow for some ventilation and drainage of sweat from inside the helmet 2 as necessary. Hidden lines associated with the flutes 17 and surfaces 18 are omitted from FIG. 4, for clarity.

An extension 78 of opening 8 is provided at a forward end of opening 8. This provides a pathway for air into the helmet 2 and clearance for a user's "Adam's apple" (where applicable).

Figure 5:
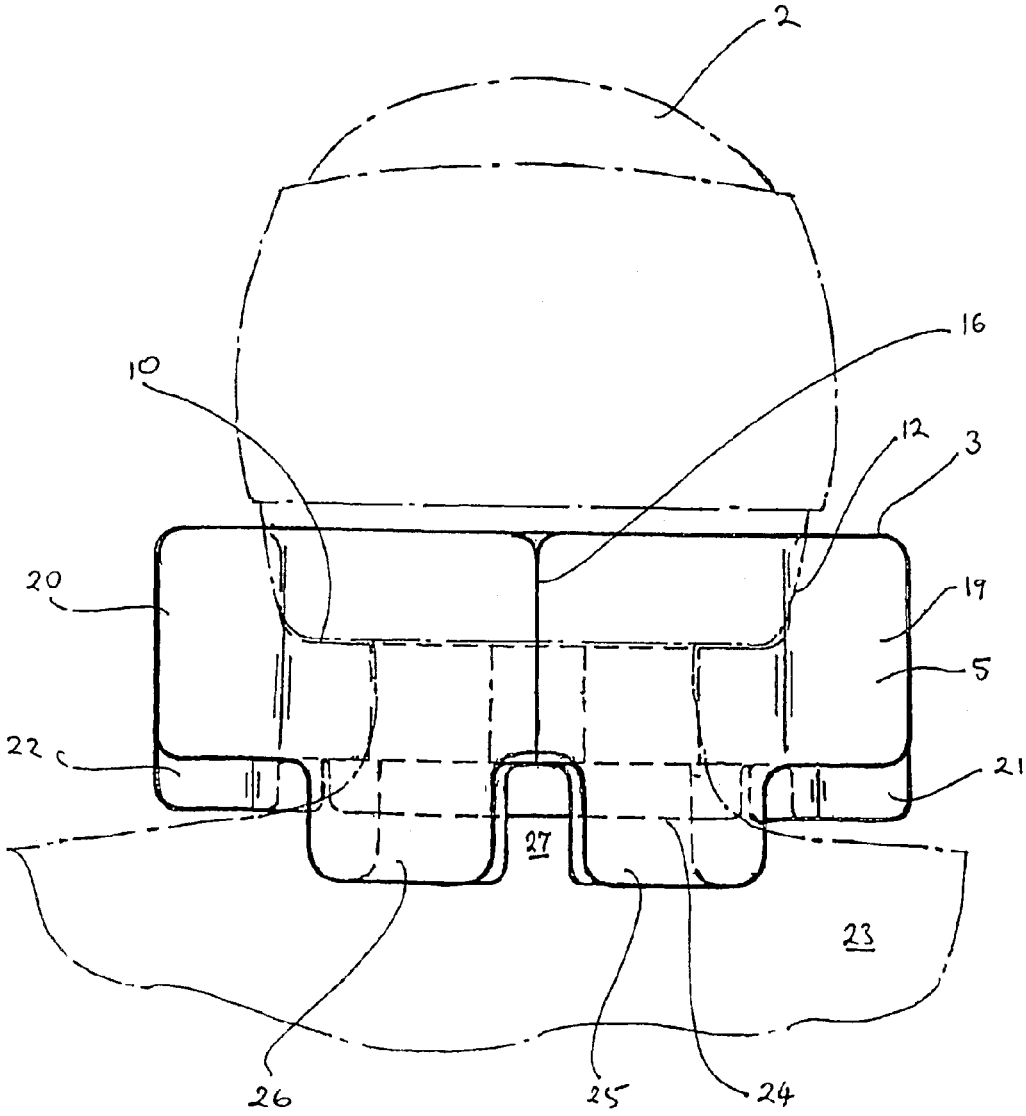
FIG. 5 is a front view of the component shown in FIG. 2 taken in the direction of arrow "C"

Collar member 3 is extended laterally by formations 19 and 20 which, in use of collar 1 and with the user 23 looking straight ahead, are located above those parts of his or her body between the neck and shoulders. As best seen in FIG. 5, formations 19 and 20 have downward extensions 21 and 22. FIG. 5 does show user 23 and it will be seen that extensions 21 and 22 are arranged to lie slightly above the user's body. Thus they provide no obstacle to user 23 turning to look to either side. (Some very slight brushing of clothing of the user 23 by extensions 21and 22 is acceptable, however, although not preferred.) Note that FIG. 5 shows the collar member 3 only in a normal position of use of collar 1, the strap 4 having been omitted for clarity.

Collar member 3 also has a rear neck pad 24 which extends downwardly from collar member 3 at its rear. Neck pad 24 does not in a normal driving position of user 23 contact the nape of his or her neck, but is arranged to do so in the event of a small degree of backward rotation of the user's head.

Collar member 3 also has two chest pads 25 and 26 which extend downwardly from collar member 3 at its front, on opposing sides of split 16. Chest pads 25 and 26 do not in a normal driving position of user 23 contact his or her chest, but are arranged to contact the chest in the event of a small degree of forward rotation of the user's head.

Chest pads 25 and 26 are spaced apart laterally, thereby to define a space 27 between them. Particularly when the collar 1 is used in conditions where there is significant airflow on front surfaces of the helmet 2 and collar 1 (as for example in some open-wheel racing cars) air flows through space 27 and upwards through extension 78 of opening 18 into helmet 2.

Because chest pads 25 and 26, rear neck pad 24 and extensions 21 and 22 do not in a normal driving position contact the body of user 23, the user 23 has a small but adequate amount of freedom to move the head, as necessary.

Chest pads 25 and 26, extensions 21 and 22 and rear neck pad 24 are all separate from each other on collar member 3, so that they operate substantially independently.

Helmet 2 is of conventional type (save for the added loop-pile fastener halves 15) and may have a normal chinstrap arrangement for securing on the user's head. The collar 1 is independent of, and does not significantly affect operation of, chinstrap.

External surface 5 of collar member 3 is cylindrical in the sense that its cross-sectional shape in plan view is substantially constant (although not circular) with height. This facilitates the use of a comparatively wide webbing-type strap 4 which in practice gives a degree of additional stiffening or reinforcement to collar member 3, by being wrapped firmly around it in use of collar 1.

Figure 2:
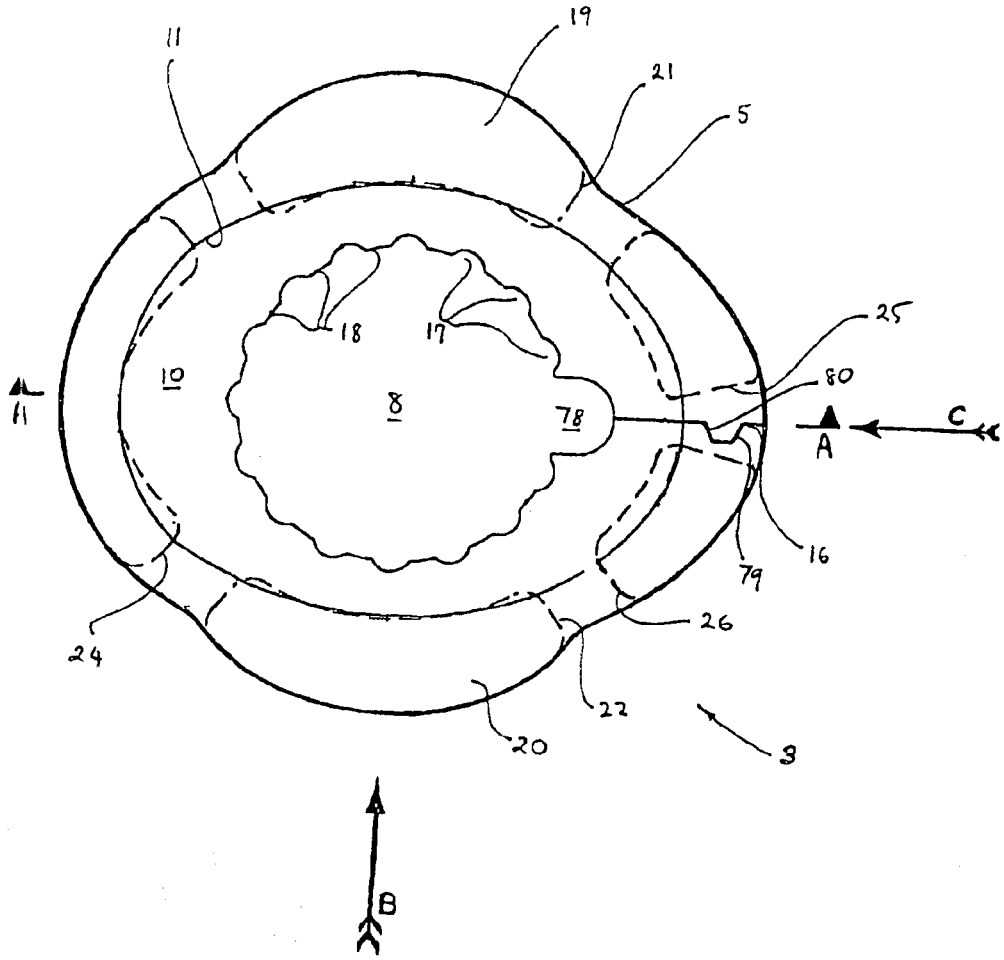
FIG. 2 is a plan view of a collar member being a component of the protective collar shown in FIG. 1.
Figure 3:
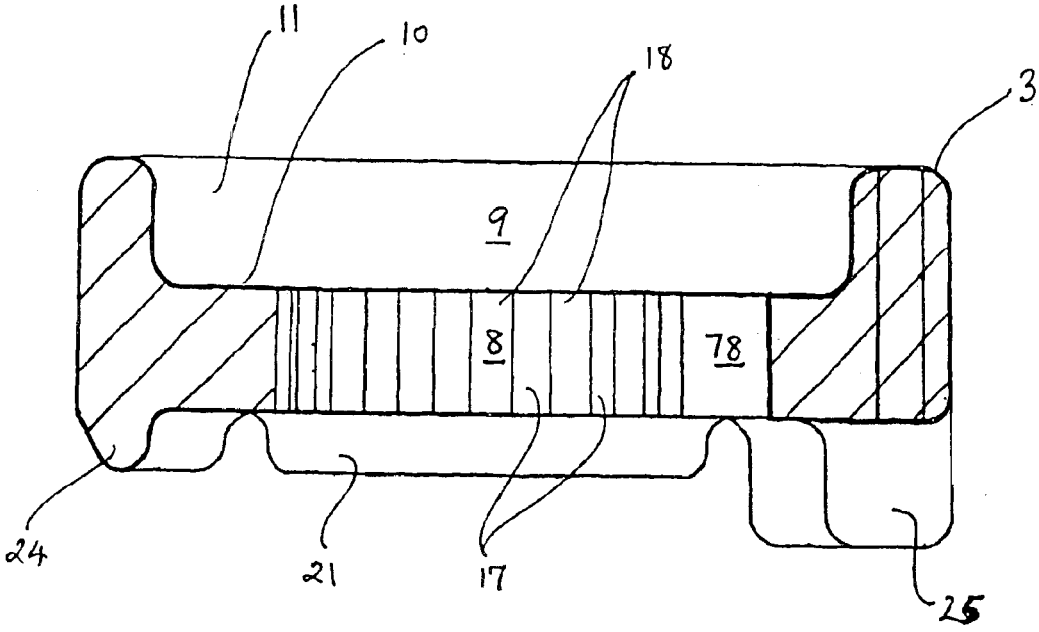
FIG. 3 is a cross sectional view of the component shown in FIG. 2, taken at Station "AA"

Split 16 is not a simple cut in collar member 3, but as best seen in FIG. 2 has opposing male and female faces (79 and 80) which are shaped to cooperate with each other when the strap 4 is secured around collar member 3. This is to ensure that there is proper alignment of the parts of collar member 3 on opposing sides of the split 16. This is also in the interests of the most secure possible retention of helmet 2 in recess 9 of collar member 3.

Figure 6:
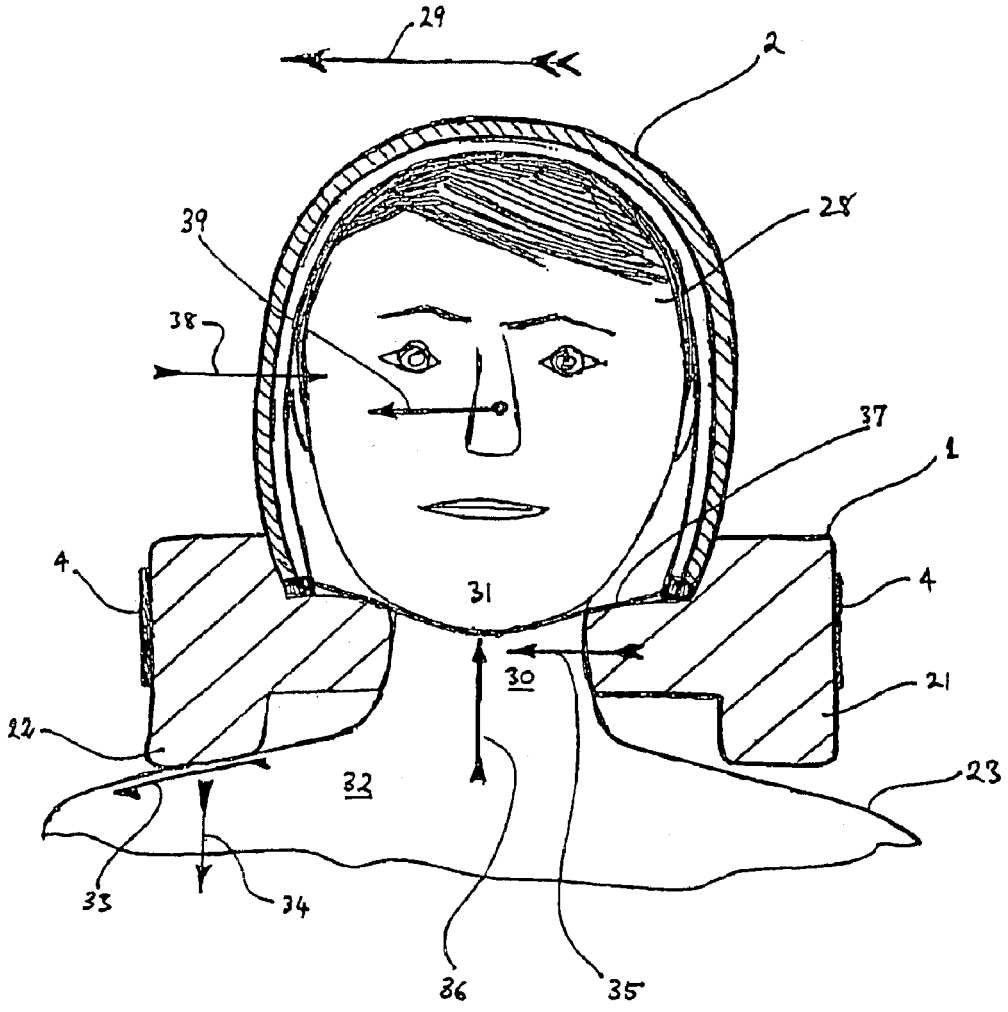
FIG. 6 is a cross-sectional sketch of a user of the collar and helmet shown in FIG. 1, seen from ahead, with the helmet seen in transverse cross-section.

FIG. 6 shows a cross-sectional sketch of user 23, seen from ahead, wearing helmet 2 and collar 1 (both seen in cross-section) and undergoing a side impact. The impact is such that the user's head 28 and the helmet 2 are moving in the direction of arrow 29, but are very rapidly stopping, so that they are actually subject to a rapid deceleration in the direction of arrow 29. The net effect is equivalent to a large, short-lived lateral force acting at the combined centre of mass of the helmet 2 and head 28 with a line of action as shown by vector 39 in FIG. 6. With helmet 2 secured within recess 9 of collar member 3, helmet 2 and collar 1 effectively act essentially as a single unit protecting head 28. The main forces applied to the user 23 due to deceleration of the head/helmet/collar combination will then be approximately as shown (not to scale) by the following vectors in FIG. 6—a friction force 33 and a downward force 34 on the upper body 32, a side force 35 applied to the neck 30, an upward force 36 applied to the chin 31 by chinstrap 37 and a side force 38 applied by helmet 2 to head 28. Of course, this is an idealization. These forces are actually resultants of pressure and shear stress distributions over areas of contact between the helmet/collar combination and the user 23. It has been assumed that the head 28 is heavier than the helmet 2, as is intended to be the case in practice, and forces developed against the top of the head 28 by chinstrap tension have been ignored as they are not relevant to this disclosure.

Figure 7:
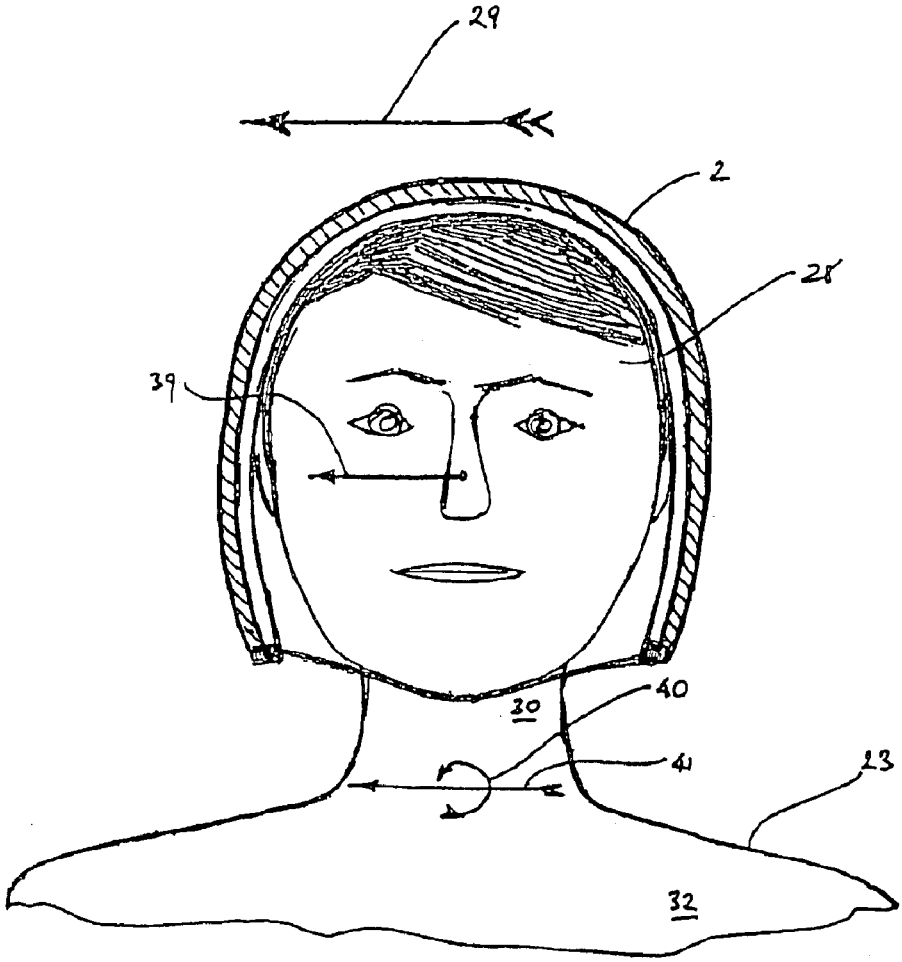
FIG. 7 is a view the same as FIG. 6 save for omission of the collar therein.

If the user 23 undergoes the same impact without the benefit of collar 1, and attempts to resist his head 28 being thrown sideways, then as shown in FIG. 7, neck 30 is subject at its base to a bending moment or torque (represented by arrow 40) and shear force 41. These are large for severe impacts, and in practice the neck 30 both bends and extends and there may be serious injury to the spinal column and/or surrounding soft tissue.

Returning to FIG. 6, the effect of the collar member 3 being closely fitting about neck 30 is that force 39 causes both forces 33 and 35. Without such close fitting between collar member 3 and neck 30, there would be no force 35, and force 33 would be correspondingly larger for a given dynamic force 39 (i.e. for a given deceleration rate). Then, if such larger friction force cannot be developed, or if the collar deformation required to do so is large, lateral displacement of head 28 will be greater, with more bending and stretching of neck 30, with higher risk of injury. That is, a close fit of neck 30 in opening 8 of collar member 3 allows more effective transfer of loads associated with a side impact to the upper body 32 and less head/neck deflection.

Exactly the same principle applies in the case of forward impacts, in which very rapid stopping throws head 28 forward. In that case, some dynamic load is transferred directly as pressure to the nape of neck 30 by collar member 3.

Accordingly, collar 1 has better performance than a conventional collar without a close fit around the neck, or no collar at all. In the case of a conventional collar (not shown) between helmet 2 and upper body 32 and snugly fitting around neck 30, it is believed that more of the component of lateral dynamic force 39 due to the mass of the helmet 2 would have to be absorbed by the neck 30 than in the case of collar 1, as the better lateral support of helmet 2 in recess 9 of collar 1 is absent.

There are other advantages of the collar 1 as described above. For example, collar 1, despite its apparent bulk, is of generally rounded shape and somewhat streamlines a wearer's helmet/neck area. Turbulence of air in the space below the helmet 2 is thought to be reduced by collar 1. This, together with direct lateral support of neck 30, in turn may help reduce buffeting-type uncontrolled movement of the helmet at high speeds in non-enclosed vehicles.

Many variations may be made without departing from the spirit and scope of the invention.

The claims defining the invention are as follows:

1. A protective collar for use with full-face crash helmets including a collar member at least partially formed from a resilient material which in use extends peripherally entirely around a user's neck said collar member having a recess in which a lower part of a full-face crash helmet is receivable and securable and helmet retaining means for retaining said crash helmet within said recess, said recess having an upwardly facing bottom surface which in use abuts said lower part of said helmet and a peripherally extending wall surface which extends upwardly from said surface to a top surface of said collar, faces into said recess and in use of said collar closely fits against said lower part of said helmet around the periphery thereof wherein in use of said collar said user's neck passes through an opening in said collar member, said opening having an upper end within said recess and inwardly facing surfaces conforming closely to at least both sides and the back of said user's neck.

2. A protective collar according to claim 1 wherein at the periphery of said opening said collar has a thickness greater than or equal to the average depth of said recess.

3. A protective collar according to claim 1 wherein a front part of said opening in use of said collar extends in a forward direction clear of said user's neck.

4. A protective collar according to claim 1 wherein said collar member has a substantially constant thickness below said recess in a direction perpendicular to said bottom surface.

5. A protective collar according to claim 1 wherein said collar member has a split at a peripheral location so that parts of said collar on opposing sides of said split are separable by a user to enable said collar to be fitted around said lower part of said helmet.

6. A protective collar according to claim 5 further including closure means for holding said parts on opposing sides of said split in defined positions against each other after fitting of said collar around said helmet.

7. A protective collar according to claim 6 wherein said closure means includes a strap secured to said collar member and having secured at one end thereof a first half of a loop-pile fastener combination, a second half of said fastener combination being secured to said collar member and located so that when said fastener halves are mated with each other said split is held closed.

8. A protective collar according to claim 7 wherein said strap is secured to an external surface of said collar member.

9. A protective collar according to claim 6 where said closure means includes a strap secured to said collar member and having secured at one end thereof a first half of a loop-pile fastener combination, a second half of said fastener combination being secured to a second end of said strap and said strap being secured to an external surface of said collar member.

10. A protective collar according to claim 1 wherein said collar member is formed as a single integral member.

11. A protective collar according to claim 5 wherein said split is at a peripheral location which in use of said collar is at the most forward point of said collar.

12. A protective collar according to claim 5 wherein said parts of said collar on opposing sides of said split have formations which in use of said collar fit cooperatively against each other.

13. A protective collar according to claim 1 wherein said collar member includes left and right formations on opposing sides which in use with said user in a looking-straight-ahead position are located adjacently to left and right upper surfaces of said users thorax between said user's neck and left and right shoulders and which are shaped and extend downwardly so as to be close to but clear of said surfaces.

14. A protective collar according to claim 1 wherein said collar member includes left and right formations on opposing sides which in use with said user in a looking-straight-ahead position are located adjacently to left and right upper surfaces of said users thorax between said user's neck and left and right shoulders so as to contact said surfaces sufficiently lightly to allow rotation of said helmet by said user without substantial restriction.

15. A protective collar according to claim 1 wherein said collar member includes at least one downwardly depending front formation at a front part of said collar member which in use is located adjacently to and clear of a clothed surface of an upper chest portion of said user and which is adapted to contact said clothed surface of said upper chest portion in the event of a predetermined amount of forward bending of said user's neck from a normal looking-straight-ahead position.

16. A protective collar according to claim 15 including two said front formations on said collar member said two front formations being laterally spaced apart from each other.

17. A protective collar according to claim 1 wherein said collar member includes a formation downwardly depending from a rear part thereof which in use is located adjacently to and clear of the nape of the neck or a surface of clothing thereon and which is adapted to contact the nape or surface of clothing in the event of a predetermined amount of rearward bending of said user's neck from a normal looking-straight-ahead position.

18. A protective collar according to claim 1 wherein said helmet retaining means includes at least one loop-and-pile fastener part secured to said collar member within said recess and positioned to mate with a cooperating part of said loop-and-pile fastener on said lower part of said helmet when said lower part is received in said recess.

19. A protective collar according to claim 1 wherein said collar member is formed at least in part from a resilient expanded plastics foam.

* * * * *